US005150659A

United States Patent [19]

Bickel

[11] Patent Number: 5,150,659

[45] Date of Patent: Sep. 29, 1992

[54] ENTERING AND EXITING STEP SYSTEM FOR VEHICLES WITH TWO STEP PIVOTAL SUPPORT FOR ACCOMMODATING PLATFORMS OF VARYING HEIGHTS

[75] Inventor: Hans Bickel, Beringen, Switzerland

[73] Assignee: Renfe, Spain

[21] Appl. No.: 670,350

[22] Filed: Mar. 15, 1991

[30] Foreign Application Priority Data

Nov. 29, 1990 [CH] Switzerland ..... 3778/90
Mar. 1, 1991 [ES] Spain ..... 9100526

[51] Int. Cl.[5] ..... B61D 23/02

[52] U.S. Cl. ..... 105/447; 105/443; 280/166

[58] Field of Search ..... 105/443, 444, 445, 446, 105/447, 448; 280/163, 166

[56] References Cited

U.S. PATENT DOCUMENTS 3,408,959 11/1968 Cripe et al. ..... 105/447
3,675,593 7/1972 Tonne et al. ..... 105/447
4,369,984 1/1983 Hagan ..... 105/445

FOREIGN PATENT DOCUMENTS 345706 12/1989 European Pat. Off. ..... 105/447
882346 1/1942 France ..... 105/443

*Primary Examiner*—Robert J. Oberleitner
*Assistant Examiner*—S. Joseph Morano
*Attorney, Agent, or Firm*—Osterlenk, Faber, Gerb & Soffen

[57] ABSTRACT

In order to board or exit a vehicle, one or a plurality of steps or plates, are provided for a negotiating of a possible difference of height by a person entering or getting off between the level of the floor of the vehicle and a platform at a higher or lower level. At least one step is forseen which is height adjustable and can be positioned at a position above the floor of the vehicle, at a position equal to the level of the floor and/or below the floor, as well.

16 Claims, 9 Drawing Sheets

ENTERING AND EXITING STEP SYSTEM FOR VEHICLES WITH TWO STEP PIVOTAL SUPPORT FOR ACCOMMODATING PLATFORMS OF VARYING HEIGHTS

BACKGROUND OF THE INVENTION

1. Field of the Invention

The present invention relates to an apparatus for entering and exiting a vehicle, the apparatus including one or a plurality of steps or floor plates for accommodating a height difference between the floor level of the vehicle and the level of a platform or of the terrain outside of the vehicle. It relates further to a railroad car having such an apparatus.

2. Description of the Prior Art

Entering or exiting railroad vehicles generally proceeds via stationary stairs or steps, folding steps or a combination of stationary stairs and movable steps. For commuter trains and subways, platforms at stations are often located at the level of the floor of the car such that no steps are needed.

For railway systems (i.e., the combination of passenger cars and stations or platforms), the level of the car or vehicle floor is located above or at the level of the platforms. This means that stairs are necessary for climbing into or descending from the railroad car.

Some of the recent high performance trains include wheels and associated undercarriages located between the car bodies which accordingly have a car floor located at a very low level. An example of such a high performance train is the TALGO PENDULAR operating predominantly in Spain, but also more recently on other European high speed railroad lines. Such vehicles or cars do not experience problems concerning passenger entering or exiting as long as they operate on railway system having platforms located at a low level such as is the case in most instances in Europe. However, when these trains are operated on a railway system having elevated platforms, such as is the case in the North East Corridor in the U.S.A. and also recently in certain high speed lines in Europe, there exists the problem of descending from the elevated platform down into the car. In some railroad networks, low level platforms are also present, creating additional problems.

Railroad trains present problems for handicapped persons bound, e.g., to wheelchairs. Entering or exiting railroad systems in which the platform and the floor of the car are located at about the same level poses little problems. However, when larger height differences between the platform and the level of the floor of the car are encountered, the person bound to the wheelchair can not use the railroad without assistance.

The floor of a railroad vehicle is commonly located about 50 centimeters to 1 meter above the platform. Wheelchairs are loaded on or off of railroad vehicles using fork-lifts, elevating platforms or wheelchair elevators mounted to the railroad car which lift the handicapped persons together with their wheelchair into the car. The above mentioned high performance trains, in which the undercarriages are mounted between the car bodies and which have an extremely low floor, are very problematic for handicapped persons in wheelchairs. Employing a fork-lift is not practicable because the wheelchair would have to be lowered from the high platform down to the low floor of the railroad car. An elevator must be mounted to the car and the elevator must be able to bypass steps provided for the entrance and exit of the car for healthy people.

SUMMARY OF THE INVENTION

It is, therefore, a general object of the invention to provide an apparatus for entering and exiting a railroad car which allows operation of the railroad car in connection with various height levels of platforms.

A further object is to provide an apparatus for entering and exiting a vehicle, the apparatus including one or a plurality of steps or floor plates for accommodating a height difference between the level of the vehicle and a platform located higher or lower than that level, or the terrain outside the vehicle. The apparatus includes at least one step or plate which is mounted in a height adjustable manner and is adapted to be positioned at a location either above the floor of the vehicle, at the level of the floor of the vehicle and/or lower than the floor of the vehicle.

Yet a further object is to provide an apparatus including at least one step arranged such that it is possible, depending upon the level of the platform located outside of the vehicle, to ascend from the level of the floor of the vehicle over a step located above the floor of the vehicle. If the level of the platform is lower than the level of the floor of the vehicle, it will be possible to descend over the step located lower than the floor of the vehicle. If the level of the floor of the vehicle equals the level of the platform, the step is either positioned at the level of the floor of the vehicle, below the same or in a folded position.

Still a further object is to provide an apparatus in which the step or plate is supported in a pivotable or rotatable manner around a longitudinal axis of rotation located at the floor area of the vehicle such that adjustment of the height of the step or plate results from the pivotal or rotational movement of the step or plate.

A further object is to provide an apparatus in which the step is mounted to the floor area such that it is positionable from a position above the floor of the vehicle by means of a pivoting movement of at least 180° into a position lower than the floor. In the position above the floor and in the position below the floor, opposite surfaces of the step may be walked upon by a person entering and exiting a railroad car.

Still a further object is to provide an apparatus in which the step or plate is mounted by supporting members which support or hold the step or plate. The supporting members themselves are rotationally mounted to the step or plate. The mounting is structured such that the supporting members are height adjustable in a displaceable manner by a parallelogram-like rotational movement.

Yet a further object is to provide an apparatus in which the step can be displaced or is height adjustable in a parallelogram-like manner by a pivotal movement of the supporting members around the axis of rotation from the level of the floor of the vehicle either to a position above or a position below the floor of the vehicle. One step or set of steps of the stair or plate or two steps may be present, whereby one step is height adjustable from the bottom of the vehicle upwards and the other step is height adjustable downwards.

A further object is to provide an apparatus in which the step or plate is held on a base part to which it is mounted. The base part is adapted to pivot approximately 180° from an upper position where the step or plate is in a position such that it may be walked upon, to a lower pivoted position such that it may be also walked upon. The latter is located at a position below the floor level.

A further object is to provide an apparatus for handicapped persons who use wheelchairs or wheelchair-like vehicles to enter or disembark a vehicle having a floor which is lower than a platform. A step or plate is rotationally height adjustable in a parallelogram-like manner around an axis of rotation located in or above the floor of the vehicle from a position at the floor of the vehicle to a position above the floor of the vehicle at the level of a higher located platform. Preferably the step rests thereupon by at least an edge area. Positioning of the step or plate to a level below the floor of the vehicle is possible by a continued rotational movement, if necessary, if the platform is located below the floor. The step or plate is suitable for a person bound to a wheelchair or a wheelchair-like vehicle, or a person severely handicapped.

Still a further object is to provide an apparatus in which the step or plate is a floor plate set into the floor of the vehicle and is supported to rotate in a parallelogram-like manner with an axis of rotation located at the level of the step or in the floor of the vehicle.

Yet a further object is to provide an apparatus having at least one further step adapted to be positioned in a step-like manner at an entrance or exit of the railroad car. If the step or plate is above the floor of the vehicle, the height difference between the step and the further step corresponds approximately to the height of the step over the floor of the vehicle.

A further object is to provide an apparatus in which the step is held by a base part which is pivotable around the axis of rotation and in which a further pivoting or folding mechanism is located at the base part. The further step is pivotable from a downwards folded, approximately vertical position extending along the step (during a ready-to-travel state of the vehicle) to an upwards folded position during a resting state of the vehicle.

Yet a further object is to provide an apparatus in which the step or plate and the further step are adapted to be arrestable or stoppable in at least three positions. A first position is at a ready-to-travel state of the vehicle, where the base part is folded upwards and the further step is in a folded back position. A second position is at a resting state of the vehicle, where the base part is folded upwards and the further step is folded outwards such as to allow a person entering or exiting the vehicle to negotiate a height difference between the floor of the vehicle and a platform located at a higher level. A third position is at a resting state of the vehicle, where the base part is pivoted downwards and the further step is folded inwards such as to allow a person entering or exiting the vehicle to negotiate the height difference between the floor of the vehicle and a platform located at a lower level.

A further object is to provide an apparatus in which the further step is adapted to be located at least partly outside of the vehicle in order to bridge the distance between the floor of the vehicle and the platform or between the step and the platform.

Yet a further object is to provide an apparatus in which when the level of the platform equals the level of the floor of the vehicle, a manually positionable auxiliary step is located on the downwards pivoted base part or downwards pivoted step or plate in order to thereby form a support on the step pivoted downwards for horizontal entry or exit of the vehicle.

A further object is to provide an apparatus having an auxiliary step adapted to be positioned or hung laterally at the entrance or exit of the vehicle or the step when it is positioned in a downwards pivoted position, such as to allow for entering or exiting the railroad vehicle from the roadway or level of the tracks.

In order to prevent operation of the steps or plates when they are being walked upon, it is a further object to provide an apparatus having control devices, preferably electrical or electronic control devices, to detect if the steps or plates are free or if persons are walking thereupon. Such control means per se are known and are used in vehicles such as commuter trains, trolley cars, buses, etc. Using such control means it is also possible to ascertain if a door is in an opened or closed state.

A further object is to provide an apparatus which includes preferably pneumatic, hydraulic or electrical operating devices for operating the apparatus, base part and step or plates. The operating devices are preferably designed such that they are mechanically stoppable or lockable in desired positions. The stopping and locking mechanisms preferably position the apparatus in case of a loss of power. In case of emergencies, the apparatus, the base part and the steps or plates are manually movable into the desired positions.

Operating means for the apparatus preferably is designed such that all boarding and exiting operations are possible in case of loss of power. Locking of the apparatus, including the steps or plates, proceeds automatically in the various positions.

A further object of the invention is to provide a railroad car equipped with such an apparatus for entering or exiting the car. The apparatus is also suitable for any kind of vehicle, such as a trolley car, a bus or a trolley bus, cable railways or cable cars for aerial tramways, etc.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
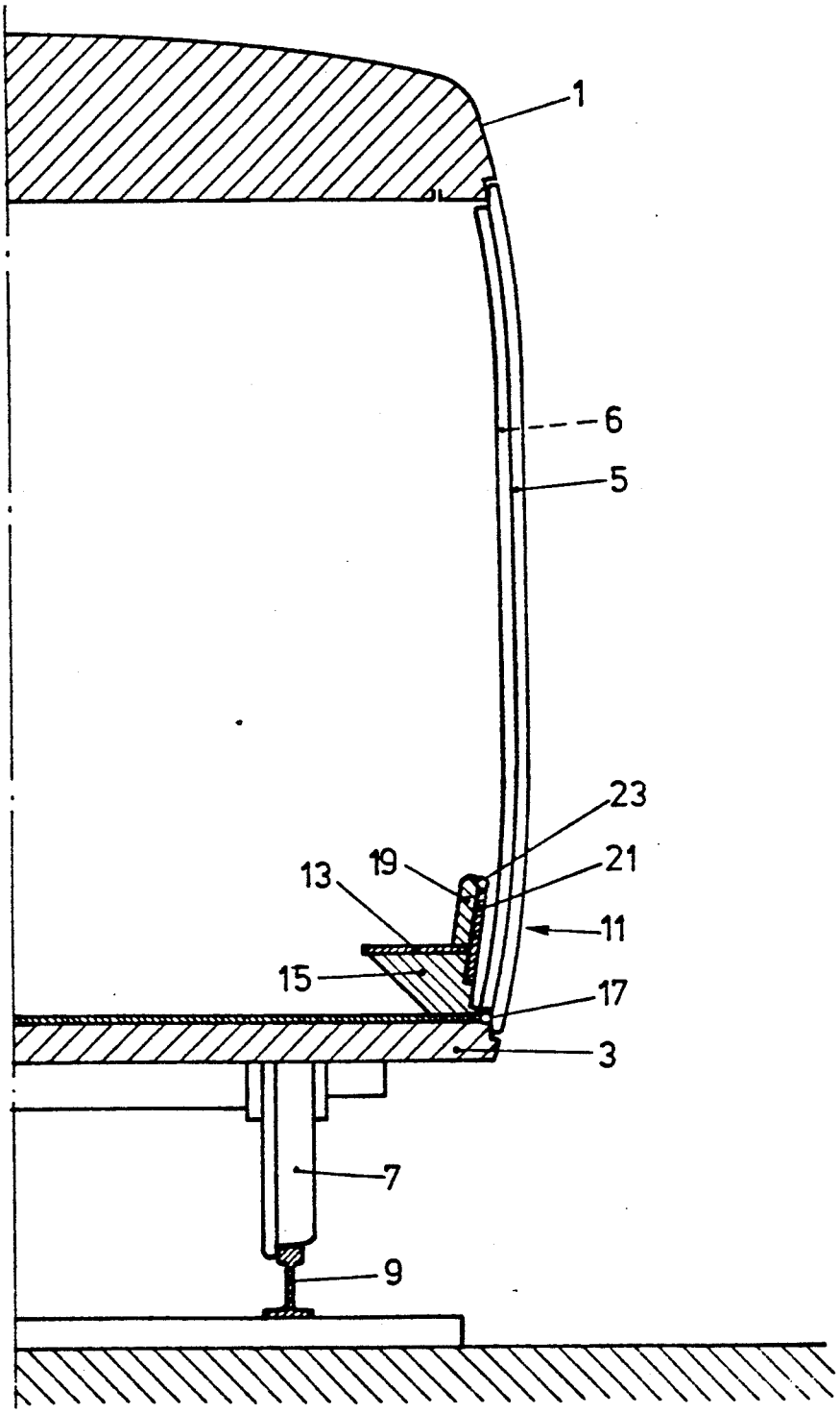
FIG. 1 is a section through a railroad car including the apparatus of the invention.

FIG. 1 illustrates in cross-section, a railroad car 1 in an operative, i.e., ready-to-travel state with a closed door 5. The railroad car illustrated in FIG. 1 in cross-section includes a car body or floor 3 of the car located quite low, which also follows from the fact that the floor 3 of the car lies directly on the undercarriage and accordingly the wheel 7 which rests on the rail 9 projects partly into the car body.

Device 11 consists substantially of a first step 13 which is supported at or on a base part 15 which in turn is pivotably mounted to the floor 13 of the car via an axis 17 of rotation. Device 11 includes, furthermore, an upwards projecting extension 19 of the base part, which in turn supports a second step 21 and is rotatable around an axis 23 of rotation. Second step 21 is folded downwards in the ready-to-travel state of the railroad car 1 as illustrated in FIG. 1. The ready-to-travel state follows also from the fact that the door 5 is located integral with wall 6 of the car body such that the latter is not visible in the illustration according to FIG. 1.

If railroad car 1 is shown stopped at a station, door 5 opens. This state is illustrated in FIGS. 2 and 3, again in cross-section.

Figure 2:
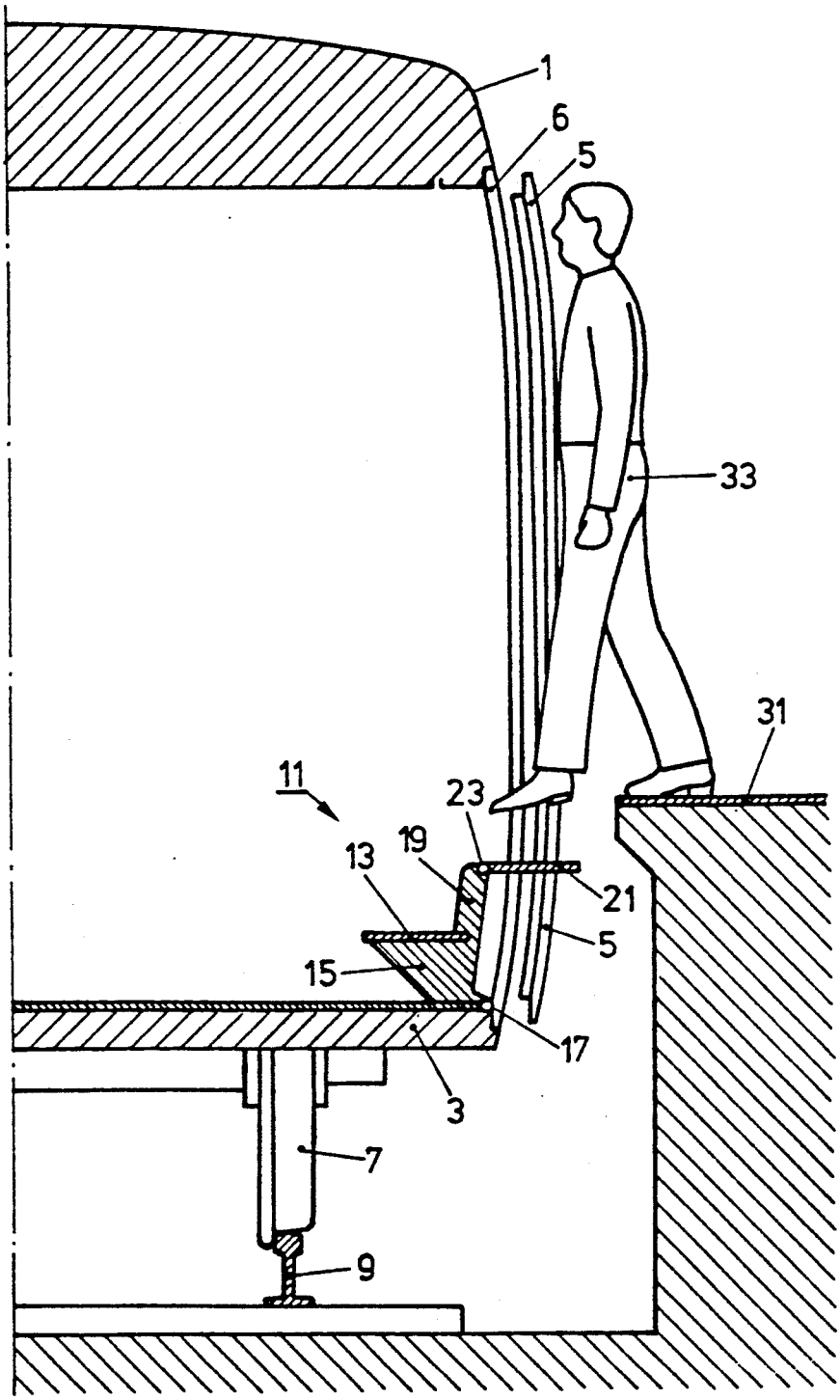
FIG. 2 illustrates the railroad car of FIG. 1 in a stopped position having an opened door, and having the apparatus arranged such that it is possible for a person to step from an elevated platform down into the car.
Figure 4:
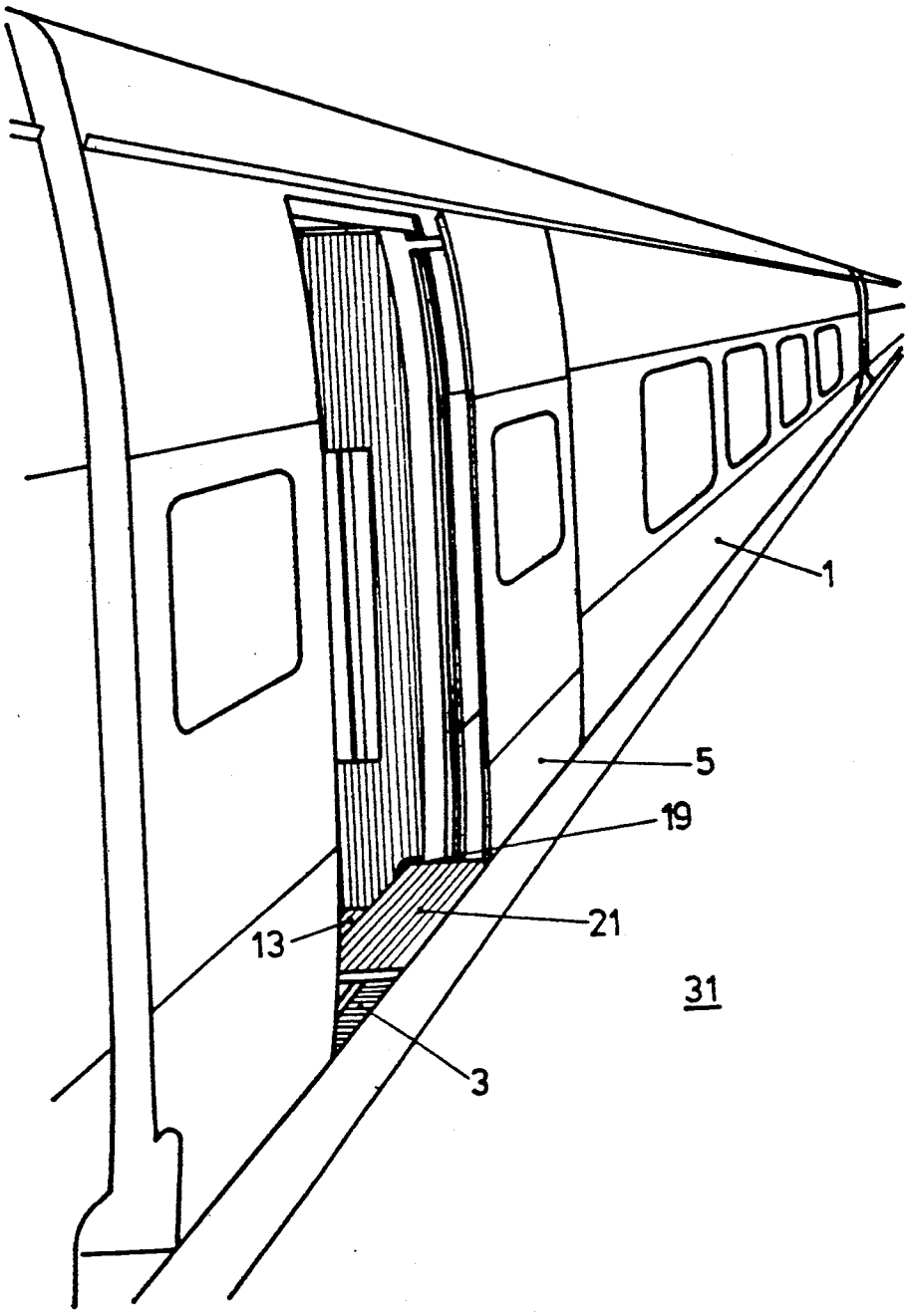
FIG. 4 is a perspective view of the car according to FIG. 2 as seen from the platform.

In FIG. 2 the railroad car stops at a platform 31 higher than the level of the floor 3 of the vehicle. In order to allow a person 33 who enters the car to negotiate the height difference from the platform 31 to the level of the floor 3 of the railroad car, second step 21 is pivoted upwards around the axis 23 of rotation. Obviously, this can happen only when the entry or exit is not obstructed, i.e. when the door 5 is opened. In FIG. 4 this is illustrated in that the door 5 is opened in the sense of a laterally displaceable door wing and thus is located slightly in front of the wall 6 of the car. In comparison with FIG. 1, the first step 13 and the base parts 15 and 19 as well remain unchanged.

Figure 3:
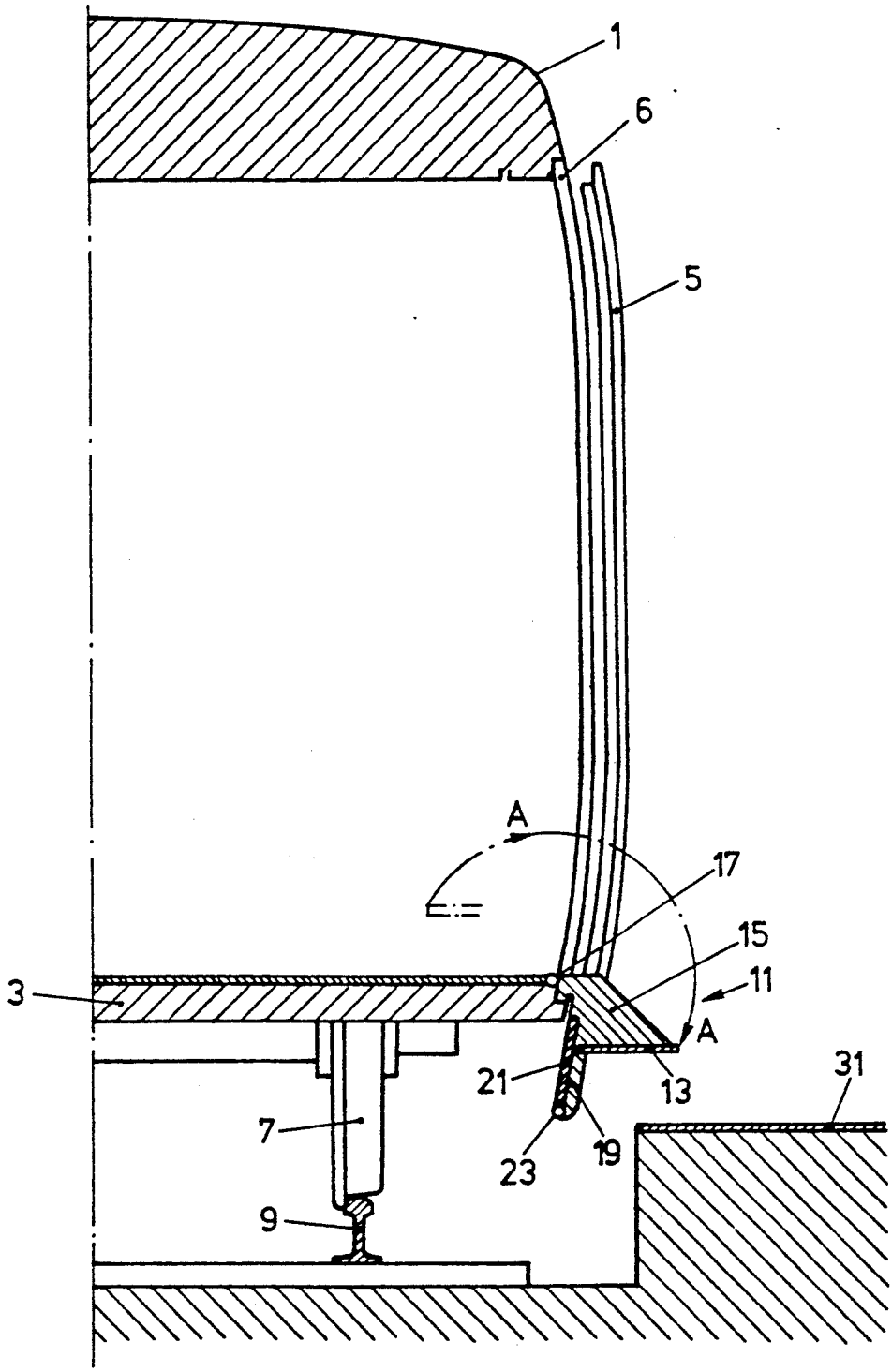
FIG. 3 illustrates in cross-section the car of FIG. 1 in a stopped position having the apparatus in a position such that it is possible to step down from the car onto a platform at a lower level.

In FIG. 3 the level of the platform is lower than the level of the floor 3 of the railroad car such that the apparatus 11 can not remain in the position as illustrated in FIG. 2. In order to allow a person to board the car I from the platform 31, the apparatus 11 is pivoted downwards (in the direction of the arrow A) so that the first step 13 is located roughly halfway between the two terrain levels and accordingly allows a comfortable entry or exit of railroad car 1. The second step 21 remains in the pivoted back state because it is not needed. As can be seen in FIG. 3, the first step 13 is now walked upon on the surface opposite the walking surface according to FIG. 2, i.e., the step 13 has been pivoted 180°. This is also true for the base parts 15 or 19 which have also been pivoted 180°.

Figure 5:
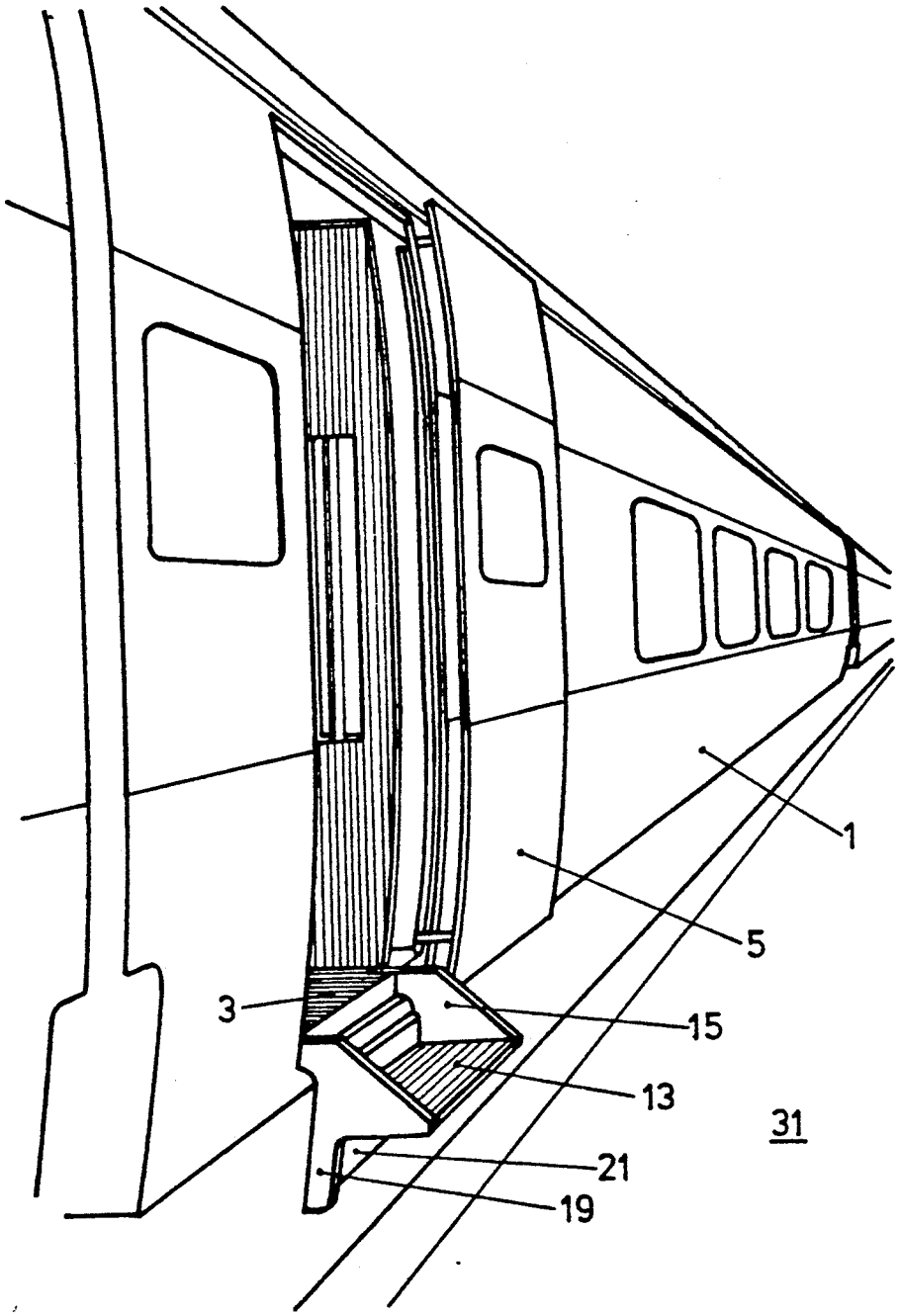
FIG. 5 is a perspective view of the car according to FIG. 3 as seen from the platform.

In FIGS. 4 and 5, the car shown in FIGS. 2 and 3 is illustrated perspectively as seen from the platform 31. A detailed description of FIGS. 4 and 5 is not needed because the situation can be quite easily derived from FIGS. 2 and 3.

Figure 6:
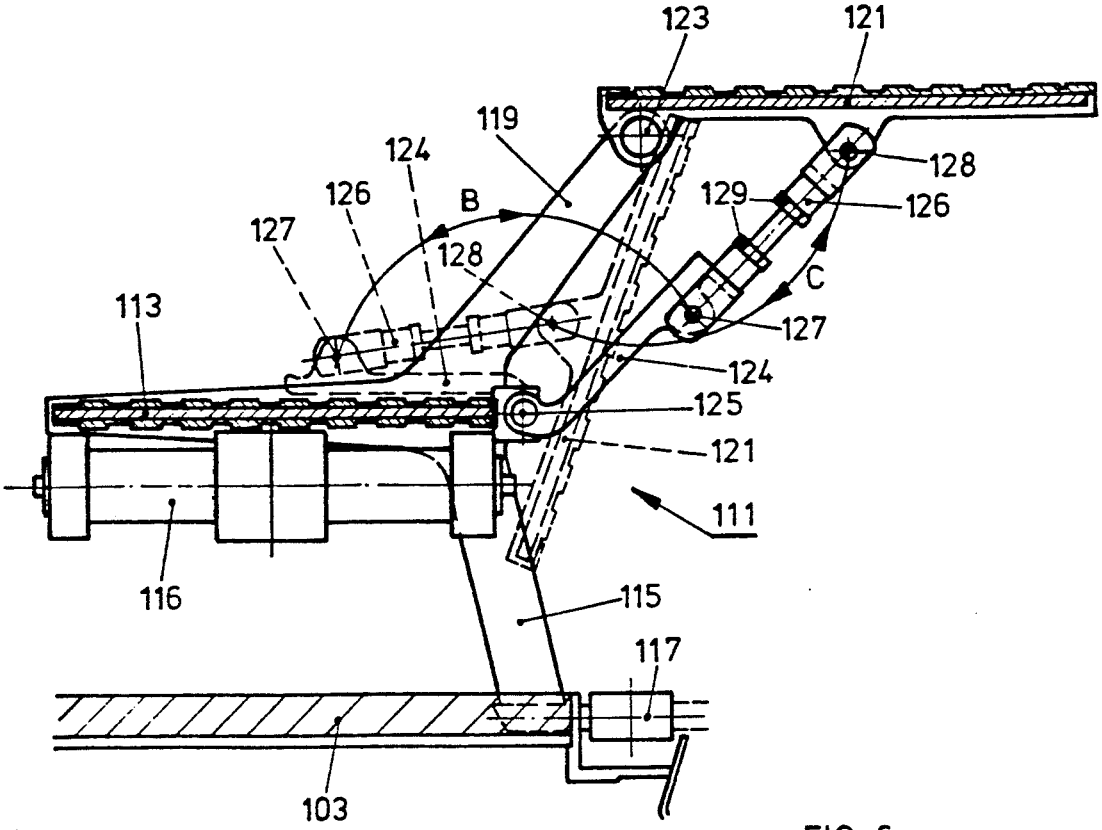
FIG. 6 is a cross-section through an apparatus for negotiating the height difference of a platform located at a higher level.
Figure 7:
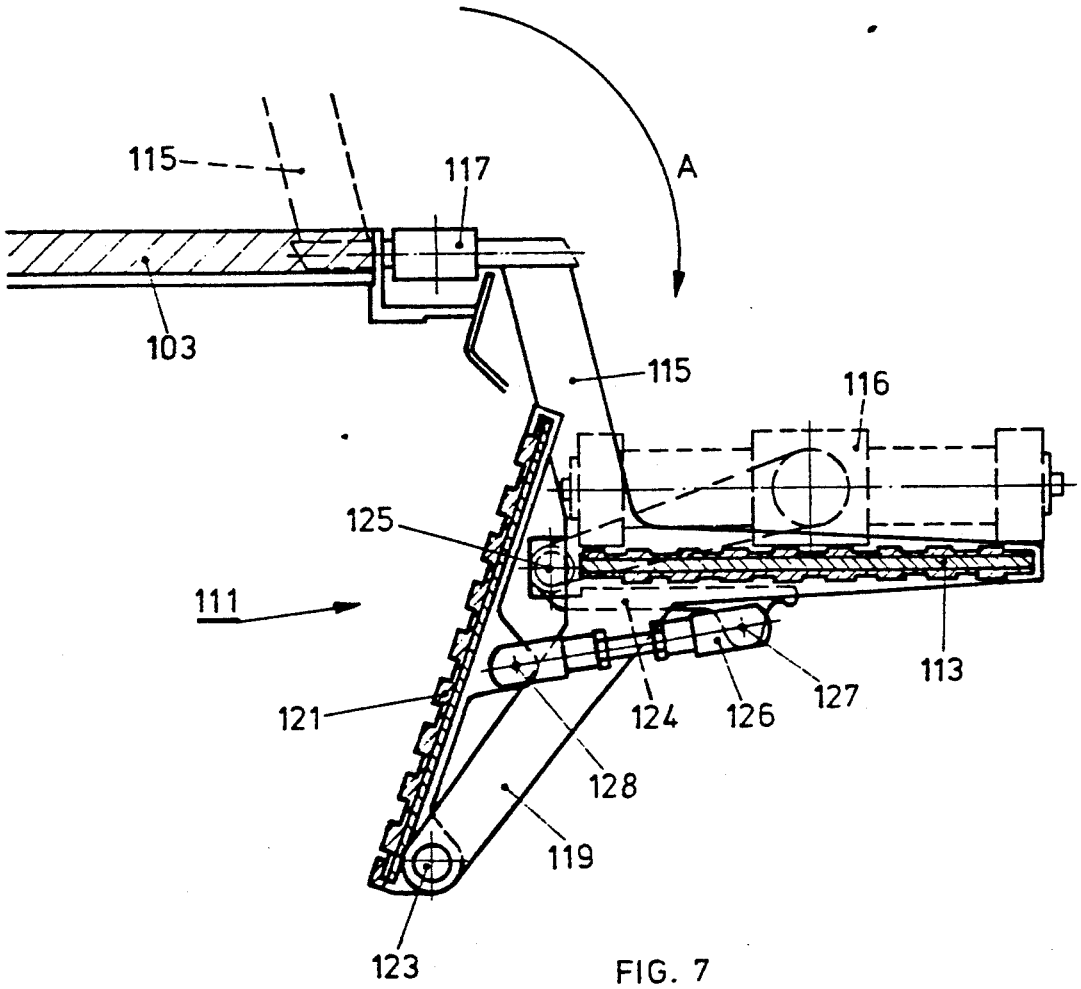
FIG. 7 is a view of the apparatus in a downwards pivoted state for negotiating the height difference of a platform located at a lower level.

In FIGS. 6 and 7, an apparatus similar to that of FIGS. 1 and 3 is illustrated in more detail.

In FIG. 6, the apparatus 11 is shown in an upwards pivoted state, for when a platform is at a higher level than the level of the floor 3 of the railroad car 103.

Apparatus 111 includes a base part consisting of a lower section 115 and an upper section 119, whereby a first step 113 is arranged lying on the lower section and a second step 121 is arranged pivotably supported at the upper section 119. The second upper step 121 is illustrated in full lines in position for a person boarding or exiting the railroad car. The second step 121 is illustrated in broken lines for when the railroad car is ready to move. The first step 113 is held laterally on a support which is rigidly mounted to the lower base section 115 The lower base section 115 is securely mounted to the bottom 103 of the railroad car via an axis 117 of rotation.

The pivoting movement of the second step 121 is made possible or triggered in that it is rotatably supported at the center of its lower side via a knuckle joint consisting of the two legs 124 and 126 on an axis 125 of rotation at the center between the lower and upper base sections 115 and 119. A further rotational bearing 127 is located at the center of the knuckle joint.

By a folding in or folding up of the second step 121, the axis 127 of rotation is moved in the direction of the arrow B and, the point 128 of rotation is moved in the direction of the arrow C. In order to avoid having the knuckle joint hamper stepping onto the first step 113, the folding in or folding up mechanism is located at the side of the step 113 at the area of the base part 119. The leg 126 of the knuckle joint is designed in the embodiment according to FIG. 6 such that a fine adjusting of the position of the second step 121 is possible, for instance by rotating the two illustrated nuts 129 which, for example, can be arranged located on a thread.

In FIG. 7, apparatus 111 is illustrated in a downwards pivoted state in order to allow exiting from the railroad car onto a platform at a lower level. Apparatus 111 has been pivoted down in the direction of the arrow A around the axis 117 of rotation or pivot axis from the position of the base part section 115 illustrated by broken lines. The first step 113 can be walked upon on the opposite surface relative to FIG. 6 and is no longer supported laterally, by the support 116 but rather held. In order to allow a free view onto the step 113, the support 116 is illustrated by broken lines.

In the position according to FIG. 7, the second step 121 is arranged in a downwards folded or folded in state, i.e., the knuckle joint is correspondingly in a "bent in" state.

The apparatus for entering or exiting of railroad cars from or to a platform at a higher or lower level illustrated in FIGS. 1–7, may obviously be altered or modified by any kind of measure. It is obviously also possible to arrange a rotating mechanism instead of a pivoting mechanism, according to which the first step can for instance be rotated in a parallel displaceable manner around an axis of rotation in the floor of the vehicle from the upper position into the lower position. The step is thereby not pivoted around 180° such as illustrated in FIGS. 1–7, but rather remains in the same position and is merely displaced parallel. This is for instance possible in that the base part is formed at the side of the step in a parallelogram-like design by two legs which both are rotationally located on a respective axis of rotation in the floor of the vehicle.

Obviously it is also possible to provide two different steps for forming the first step whereby the first step is rotated upwards in a parallel displaceable manner out of the floor of the vehicle and a further step downwards out of the floor of the vehicle. It is possible to place the step arrangement at a lower level in a stationary fashion, such as is still common practice in railroad cars, and to merely arrange a pivotable or rotational apparatus located at a higher level that may be rotated or pivoted out of the floor of the vehicle.

Figure 8:
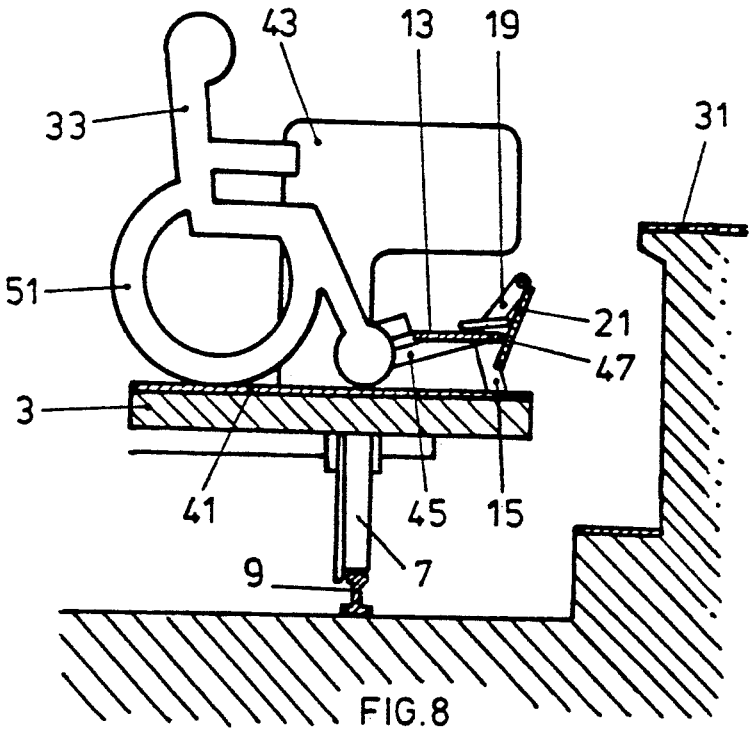
FIGS. 8–10 are schematic sectional views of a wheelchair elevator in accordance with the invention for allowing a person bound to a wheelchair to negotiate a height difference from a floor of a vehicle located at a lower level to a platform located at a higher level.
Figure 9:
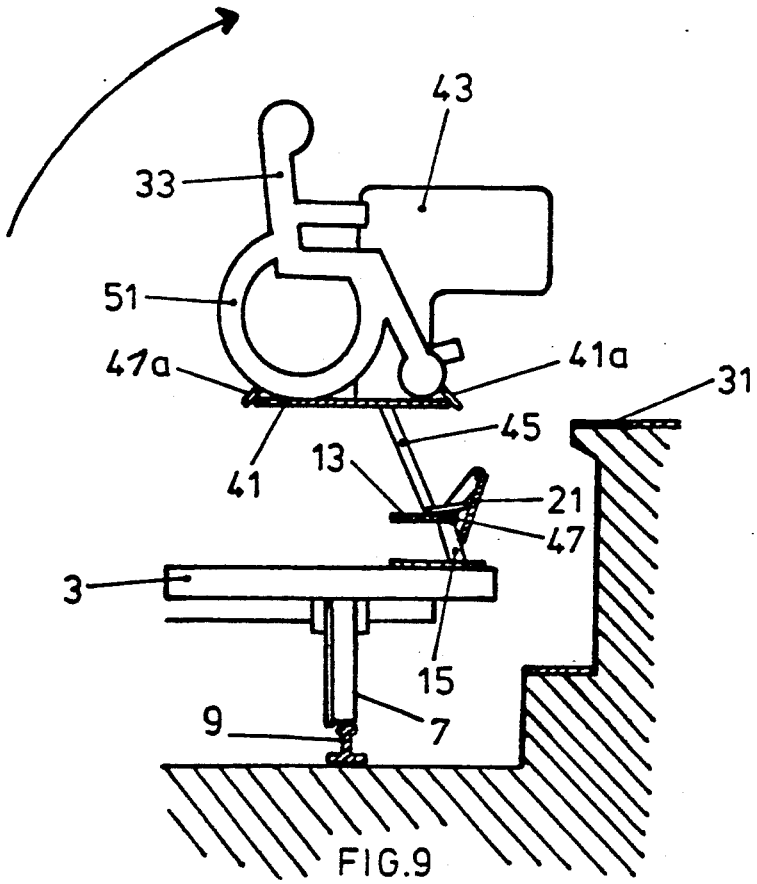
Figure 10:
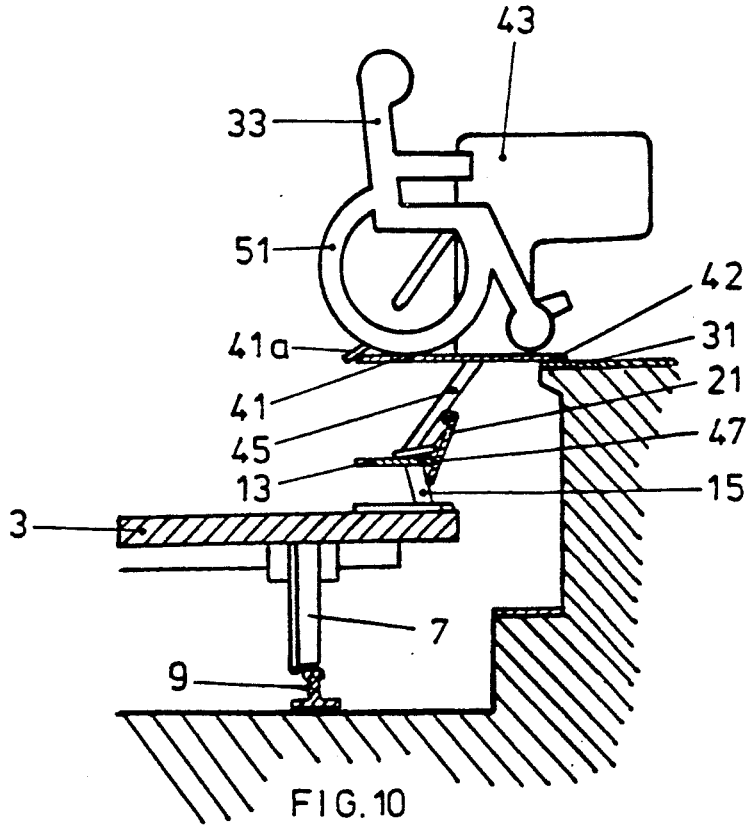

FIGS. 8–10 illustrate a wheelchair elevated such that a handicapped person in a wheelchair can board or exit a platform located at a higher level than a vehicle located at a low level.

In FIG. 8, a person 33 ready to get out of the car sits in a wheelchair 51 located on a floor plate 41 set into the floor 3 of the vehicle. The floor plate 41 extends substantially along the entire length of the first step 13 which corresponds to the first step according to the earlier described figures. Also, the base part 15 (by means of which the first step 13 is pivotably mounted to the floor 3 of the vehicle), the upwards projecting extension 19 and the second pivotable step 21 correspond to the respective parts illustrated in FIGS. 1–7. The floor plate 41 set into the floor 3 of the vehicle is in turn mounted via respectively laterally located lever arms 45 to the base part 15. Lever arms 45 are supported laterally of the first step 13 for rotation around an axis 47 of rotation. A sidewall part 43 is also located laterally of the floor plate 41, which side wall part 43 can for instance contain control elements for operation of the wheelchair elevator and additionally can serve as a guide for the hand of handicapped persons or as a handle to be gripped by a handicapped person. This side wall can be located either at one side of the floor plate 41 or also at both sides.

In FIG. 9, the function of the wheelchair elevator in accordance with the invention is illustrated schematically in that the floor plate 41 is moved upwards in a parallelogram-like manner out of the floor 3 of the vehicle and passes over the first step 13. In order to prevent rolling away of the wheelchair 51, two small parts 41*a* located at both sides are automatically pivoted when the floor plate 41 begins to lift off such as to form an upwards projecting, arresting device for the wheelchair. The rotational movement of the floor plate 41 proceeds around the axis 47 of rotation which is located at the base part 15 at the level of the first step 13.

As soon as the floor plate 41 has rotated to such an extent around the axis 46 of rotation that it comes to rest with its front portion 42 onto the platform 31, the rotating movement is interrupted. Together with the floor plate 41 coming to rest on the platform 31, the forward located parts 41*a* are pivoted back into the plane of the floor plate 41 such that the wheelchair elevator is prevented from rotating too much. It is possible to arrange the detecting devices such as, for instance, feelers in the forward portion 42 of the floor plate 41 in order to automatically interrupt the rotational movement. The movement of the plate 3 to the level of the floor 3 of the vehicle proceeds in an analogous manner in the opposite direction.

The drive system for performing the movements of the wheelchair elevator can be hydraulic, pneumatic or electric. It is, thereby, again important that the drive devices are designed such that upon loss of power, the apparatus or wheelchair elevator still remains in a functioning state and can be locked in its end positions.

The statements made relative to FIGS. 1–7 are also applicable to the design in accordance with FIGS. 8–10, namely that the embodiments can be altered or modified. For instance, it is possible to position the floor plate by a continued rotational movement according to FIGS. 8–10 at a level lower than the level of the railroad car when the platform is located at a lower level. It is also possible to eliminate the fork-lift and substitute therefor the wheelchair elevator in accordance with the invention in order to lift a wheelchair from a platform located at a lower level up to a railroad car.

The illustration of operating and driving devices, such as pneumatic, hydraulic, electrical operating devices and also electronic or electric control devices, has been purposely omitted in FIGS. 1–10 in order not to impair a clear illustration of the figures. These additional operating, control and driving devices are generally known, specifically for commuter trains, express trains, and rural transportation vehicles, such as trolley cars and trolley buses.

It is also possible to manually operate the device of the invention in emergencies.

The disclosed apparatuses are not only suitable for railroad cars such as illustrated in FIGS. 1–5, but also for any kind of other vehicles such as trolley cars, buses or trolley buses, aerial tramways and cable railways or cable cars.

In the invention, at least one step or plate can be in a height adjustable manner located at at least one position above the floor of the vehicle and at at least one position on and/or below the level of the floor of the vehicle.

While there are shown and described present preferred embodiments of the invention, it is to be distinctly understood that the invention is not limited thereto, but may be otherwise variously embodied and practiced with the scope of the following claims.

I claim:

1. Apparatus for enabling boarding and getting off a vehicle, wherein the vehicle includes a floor and an entry door into the vehicle for moving onto and off the floor, and wherein the floor of the vehicle is at one of either the same level as a platform outside the vehicle door, or higher than the platform, or lower than the platform;

the apparatus comprising at least a first step generally at the floor and at the door, height adjustable means mounting the first step in a height adjustable manner with respect to the floor of the vehicle selectively at the level of the floor of the vehicle, above the floor of the vehicle or lower than the floor of the vehicle for enabling a person boarding or getting off the floor of the vehicle through the door to move from or to the platform outside the door of the vehicle, the height adjustable means comprising a support and a pivot axis for the support, the pivot axis extending generally longitudinally of the vehicle at the door and generally at the floor of the vehicle, the first step being supported on the support at a location spaced away from the pivot axis and being pivotable around the pivot axis between a first pivot position where the first step is at one height and a second pivot position where the first step is at another height with respect to the floor of the vehicle, wherein in the first pivot position of the support, the first step is supported above the floor of the vehicle, and at the second pivot position of the support, the first step is supported below the floor of the vehicle, and a second step supported by the support above the first step when the first step is in the first position above the floor of the vehicle, and the second step then also being located further toward the floor of the vehicle than the first step.

2. The apparatus of claim 1, wherein said vehicle is a railroad car.

3. The apparatus of claim 1, wherein the first step has opposite surfaces, the support is pivotable around the pivot axis over a pivot angle of approximately 180° so that in the first pivot position of the support, one of the surfaces of the first step is available to be stepped on and at the second pivot position of the support, the opposite surface of the first step is available to be stepped on.

4. The apparatus of claim 3, wherein in the first pivot position of the support, the first step is supported above the floor of the vehicle, and at the second pivot position of the support, the first step is supported below the floor of the vehicle.

5. The apparatus of claim 4, wherein in its first pivot position above the vehicle floor, the first step is inside the vehicle door, whereas in its second position below the vehicle floor, the first step is outside the door of the vehicle.

6. The apparatus of claim 4, wherein the first step is rigidly mounted to the support at a location spaced away from the pivot axis; the support is pivotable from its first position at which the first step is above the floor around the pivot axis at least approximately 180° into its second position at which the first step is below the floor of the vehicle.

7. The apparatus off claim 1, wherein the second step is above the first step by a distance such that the difference of the height between the second step and the first step corresponds at least approximately substantially to the height of the first step above the floor of the vehicle.

8. The apparatus of claim 1, wherein the first step is held to the support at a location spaced from the pivot axis and being pivotable with the support around the pivot axis;

the second step being pivotably supported to the support at a second pivot axis to be pivotable with respect to the support between a position generally parallel to the first step for enabling a person to walk on the first and second steps and a folded down position.

9. The apparatus of claim 8, wherein the first and second steps are adapted to be supported and held in a selected one of three positions, including a first position where the support extends upward and the second step is folded down with respect to the support so as to not be in position to be stepped on;

a second position where the support extends upward and wherein the second step is folded outward from the support toward the door of the vehicle, whereby the second step is available to be stepped on along with the first step; and a third position where the support is pivoted downward with respect to the floor of the vehicle so that the first step is below the floor of the vehicle.

10. The apparatus of claim 9, wherein in the third position, the second step is folded inwardly against the support, whereas the first step is extending outward of the door of the vehicle.

11. The apparatus of claim 9, wherein the first step is located at least partially laterally outside the door of the vehicle when the support has been pivoted downwardly to the third position to pivot the first step downward below the floor of the vehicle.

12. The apparatus of claim 1, wherein the support supports the second step at least partly outside of the door of the vehicle when the first step is in the first position.

13. Apparatus for enabling boarding and getting off a vehicle, wherein the vehicle includes a floor and an entry door into the vehicle for moving onto and off the floor, and wherein the floor of the vehicle is at one of either the same level as a platform outside the vehicle door, or higher than the platform, or lower than the platform;

the apparatus comprising a step support at the floor and at the door of the vehicle, first means for generally pivotally mounting the support to pivot between a first position and a second position;

a first step on the support and located such that with the support in the first position, the first step is inside the vehicle door and at a height above the vehicle floor to be stepped on, the first step being movable with the support such that in the second position of the support, the first step is moved outside the door and below the floor of the vehicle;

a second step mounted to the support at a location such that the second step is above the first step when the support is in the first position and the second step then being further toward the door of the vehicle than the first step, such that the floor, the first step and the second step may be stepped on in sequence with the support in the first position, and with the support in the second position thereof, the second step is out of position to be stepped on.

14. The apparatus of claim 13, wherein the first step has opposite surfaces such that in the first position of the support, one of the surfaces of the first step is available to be stepped on and in the second position of the support, the opposite surface of the first step is available to be stepped on.

15. The apparatus of claim 13, wherein the second step is pivotally supported to the support to be pivotable with respect to the support between a position generally parallel to the first step for enabling a person to walk on the first and second steps and a folded position.

16. The apparatus of claim 15, wherein the support is pivotable around the first pivot axis over a pivot angle of approximately 180° between the first and second pivot positions of the support.

* * * * *